US007018072B2

(12) United States Patent
Mier-Langner et al.

(10) Patent No.: US 7,018,072 B2
(45) Date of Patent: Mar. 28, 2006

(54) PULL-OUT LAMP HOLDER ASSEMBLY

(75) Inventors: Alejandro Mier-Langner, Providence, RI (US); Robert Scott Gosnell, Weymouth, MA (US); James E. Kuchar, Fall River, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 132 days.

(21) Appl. No.: 10/348,312

(22) Filed: Jan. 21, 2003

(65) Prior Publication Data

US 2003/0137843 A1 Jul. 24, 2003

Related U.S. Application Data

(60) Provisional application No. 60/351,181, filed on Jan. 22, 2002.

(51) Int. Cl.
*F21S 4/00* (2006.01)

(52) U.S. Cl. ..... 362/285; 362/217; 362/220; 362/652

(58) Field of Classification Search ..... 362/285, 362/217, 219, 220, 429, 225, 421, 437, 448, 362/378, 260, 289, 287, 226, 652, 655, 656, 362/288, 418
See application file for complete search history.

(56) References Cited

U.S. PATENT DOCUMENTS 1,902,026 A 3/1933 Hall
2,268,446 A 12/1941 Gaynor
2,559,639 A * 7/1951 Kruger ..... 362/217
2,816,216 A 12/1957 Dasher
2,998,512 A 8/1961 Duchene et al.
3,018,082 A 1/1962 Berger
3,070,689 A * 12/1962 McIntosh ..... 362/219
3,247,368 A 4/1966 McHugh
3,345,451 A 10/1967 Kember et al.
3,436,716 A 4/1969 Amis et al.
3,466,594 A 9/1969 Detch
3,524,053 A * 8/1970 Johnson ..... 439/242
3,752,977 A 8/1973 Davis
3,781,759 A 12/1973 Shelly
3,892,457 A 7/1975 Detch
3,909,100 A 9/1975 Hodge
4,173,037 A 10/1979 Henderson et al.
4,238,815 A 12/1980 Price
4,293,895 A 10/1981 Kristofek (Continued)

*Primary Examiner*—John Anthony Ward
*Assistant Examiner*—Bao Q. Truong
(74) *Attorney, Agent, or Firm*—James E. Cole; Middleton Reutlinger

(57) ABSTRACT

A lamp holder assembly for use in thin profile lighting fixtures having fluorescent lamps wherein there is a narrow gap between the lamps and the reflector so that accessing the lamps is difficult. The lamp holder assembly pulls out so that access can be gained to the lamps. The lamp holder assembly includes a base member and a bracket member with lamp sockets affixed to the bracket member. The bracket member slides against the base and is held in position on the base by slots in the bracket member that engage guide pins extending from the base. Further guidance for the bracket member may include twin parallel rails extending form the base and spaced so as to form a channel in which the bracket member travels. The pull-out assembly may also have a leaf spring attached to the base member that further guides the bracket member while in motion.

11 Claims, 7 Drawing Sheets

U.S. PATENT DOCUMENTS 4,498,126 A * 2/1985 Hernandez ..... 362/220
4,535,393 A 8/1985 Aspenwall
4,642,741 A * 2/1987 Cohn ..... 362/320
4,744,767 A 5/1988 Henrichi et al.
4,803,600 A * 2/1989 Pepping ..... 362/217
4,947,297 A 8/1990 Druffel et al.
4,992,915 A * 2/1991 Meister ..... 362/217
5,006,970 A * 4/1991 Mackiewicz ..... 362/217
5,109,323 A 4/1992 Waycaster
5,434,762 A 7/1995 Shemitz
5,469,348 A * 11/1995 Wong ..... 362/217
5,720,546 A * 2/1998 Correll et al. ..... 362/221
5,727,869 A 3/1998 Crosby et al.
5,855,487 A 1/1999 Kunishi
5,884,994 A 3/1999 Herst et al.
6,059,424 A 5/2000 Kotloff
6,102,550 A 8/2000 Edwards

* cited by examiner

PULL-OUT LAMP HOLDER ASSEMBLY

CROSS-REFERENCE TO RELATED APPLICATIONS

This application claims the benefit of U.S. Provisional Application Ser. No. 60/351,181, filed Jan. 22, 2002.

STATEMENT REGARDING FEDERALLY SPONSORED RESEARCH OR DEVELOPMENT

Not applicable.

BACKGROUND OF THE INVENTION

1. Field of the Invention

This invention relates to lamp holder assemblies, and more particularly to a pull-out lamp holder assembly for slim profile, tubular fluorescent lamps for use in a reduced scale, compact, shallow luminaire with tight spacing between the lamps and the reflector forming the optical system of the luminaire.

2. Description of Prior Art

Tubular fluorescent lamps commonly have a pair of base pins extending from each end of the lamp. The preferred lamp sockets for these tubular fluorescent lamps accept the lamp pins at one orientation and require that the lamp be rotated 90 degrees to create electro-mechanical contact between the socket contacts and the lamp pins. Thus, the lamps become mechanically locked into the sockets. Prior art lamp holders for tubular fluorescent lamp luminaires are typically non-movably attached to the luminaire.

With the introduction of slim profile, triphosphor high output fluorescent lamps designers have been able to reduce the scale of fluorescent luminaires. As a result of the luminaire's smaller scale, optical distribution considerations require a tight spacing between the optical reflector and lamp. However, this tight spacing complicates installing and replacing lamps in the luminaire.

For example, T5HO type lamps have a diameter of ⅝ inch, and provide optimum output at a high ambient temperature (95° F.), allowing for the design of more shallow, compact luminaires producing luminaires with high overall efficiencies. However, with such shallow, compact designs, the optical package design may require the lamps to be placed within 2 mm of the reflector. With reflector designs that wrap around the lamps, and in luminaires utilizing multiple lamps in close proximity to each other, there is little or no access to grasp the lamp body to perform the twist and lock/unlock procedure for installing/removing the lamps from the lamp sockets.

BRIEF SUMMARY OF THE INVENTION

Thus, it is an object of the present invention to provide a lamp holder assembly that, when pulled, can slide out of a luminaire to allow space behind the lamps.

It is a further object of the invention to provide a lamp holder assembly for use in reduced scale, compact shallow luminaires for slim profile, linear fluorescent lamps.

It is yet a further object of the invention to provide a pull-out lamp holder assembly having travel limits for reliable use and accurate positioning of the lamps with respect to the reflector.

It is even a further object of the invention to provide a pull-out lamp holder assembly which has smooth travel and a locating snap feel when the assembly reaches its limits of travel.

These and other objects are met by a pull-out lamp holder having a base member with a plurality of guide pins projecting from the base member and a bracket member with a plurality of parallel slots in alignment with the guide pins such that the bracket member is slidingly affixed to the base member. The bracket member has at least one lamp socket attached to it.

The guide pins can each have a head that flares out so that the head has a diameter greater than the diameter of the slot. This prevents the guide pins from disengaging from the slots. The guide pins may each also consist of a boss with a tapered neck that extends through the slot, preventing the head from being overtightened and compressing onto the slot and hampering motion of the bracket member.

The pull-out lamp holder can also have various features that assist in guiding the bracket member when it is moved between a forward and a rear position. For example, the lamp holder may further consist of a leaf spring affixed to the base member and passing through a slot in a rear return depending from a back edge of the bracket member. The leaf spring may have a bend providing additional bias against the bracket member rear return to produce a locating snap feel when the bracket member reaches its forward or rear position. Alternatively, or in combination with the leaf spring, the base member may have a pair of parallel rails depending therefrom positioned parallel to the plurality of slots and spaced so as to form a channel therebetween. The bracket member is held between the twin parallel rails and rides within the channel, thus further keeping the bracket member within a predetermined path.

The lamp holder may also contain elements that aid in limiting the motion of the bracket member in a forward and rear direction as well. For example, a rib depending from the base member can be positioned such that a rear return depending from a back edge of the bracket member contacts the rib when the bracket member is slid to a forward direction, preventing further travel in the forward direction. The lamp holder may also contain a front return depending from a front edge of the bracket member such that the front return contacts a front edge of the base member when the bracket member is slid to a rear position, preventing further travel in the rear direction.

For a better understanding of the present invention, together with other and further objects thereof, reference is made to the following description, taken in conjunction with the accompanying drawings, and its scope will be pointed out in the appending claims.

DETAILED DESCRIPTION OF THE INVENTION

Figure 1:
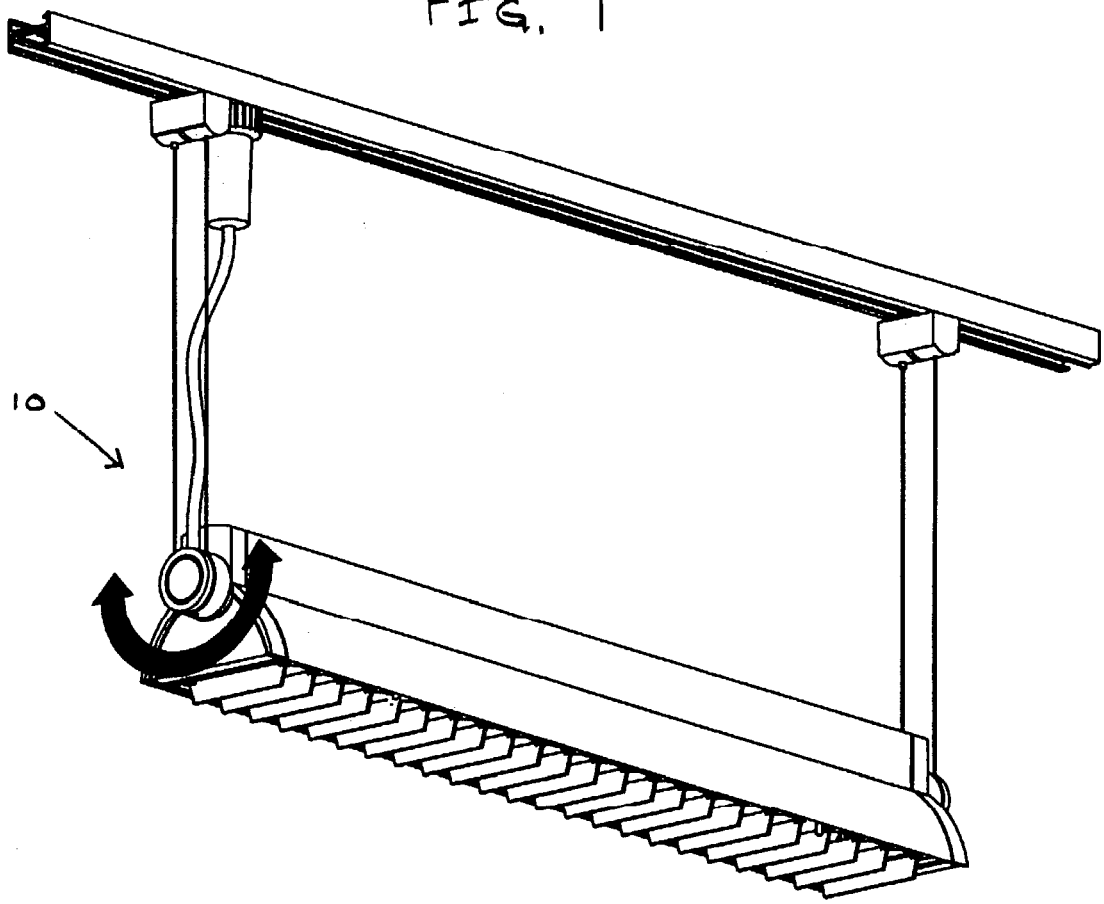
FIG. 1 is a perspective view of typical application utilizing slim profile, high output tubular fluorescent lamps in a compact luminaire.

Advancements in tubular fluorescent lamp technology, such as the T-5 family of lamps, have enabled designers to develop compact, reduced scale luminaires, such as the track mounted luminaire 10 of FIG. 1. As shown in FIG. 1, such reduction in scale permits an elegant streamlined design for the luminaire 10. In addition, incorporation of the lamp technology into the luminaire allows the designer to realize the increased efficiency and optical performance of the lamps associated with the technological developments.

Figure 2:
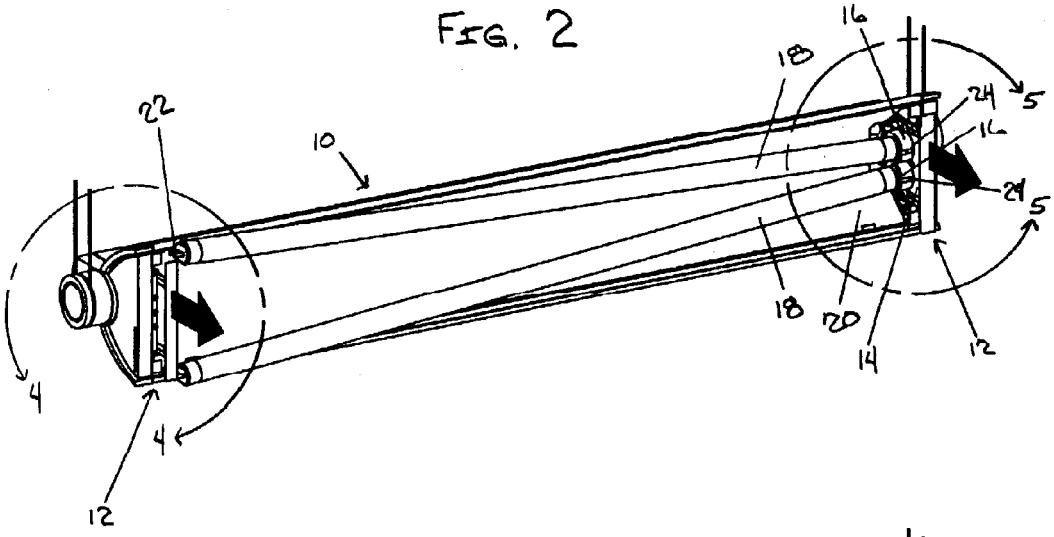
FIG. 2 is a perspective view of the luminaire of FIG. 1 utilizing the pull-out lamp holder assembly of the present invention, with the lamp holder assemblies in the re-lamping position.

As shown in FIG. 2, the pull-out lamp holder assembly 12 of the invention allows a bracket member 14 which carries the lamp sockets 16 and lamps 18 to be pulled forward from the luminaire 10 to create additional space between the lamps 18 and the reflector 20 of the luminaire 10. This additional space allows enough room to grasp the lamps 18 in order to rotate or twist the lamps 18 by 90 degrees so that the lamp base pins 22 align with the lamp socket slots 24 for installation or removal of the lamps 18 from the lamp sockets 16. Thus, FIG. 2 shows the lamp holder assemblies 12 in a forward or re-lamping position.

Figure 3:
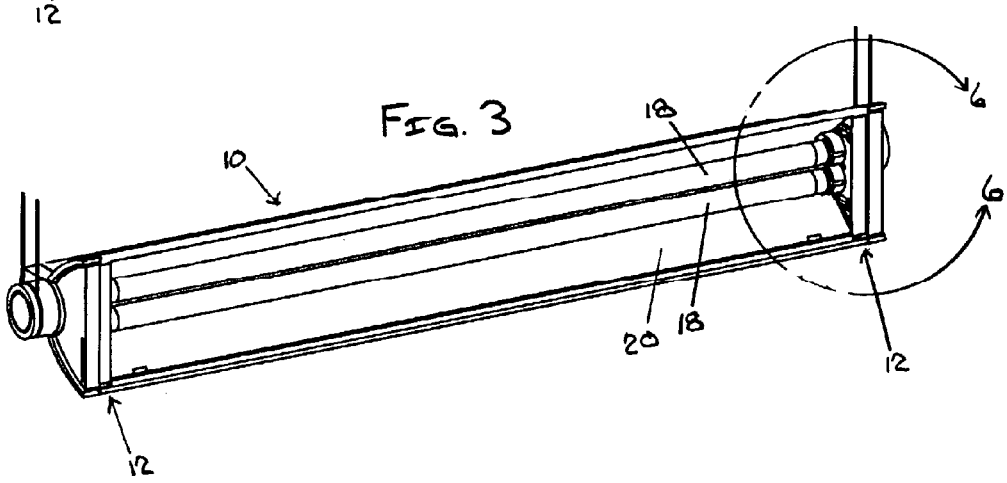
FIG. 3 is another view of the luminaire of FIG. 2 with the lamp holder assemblies in the operating position.

FIG. 3 shows the luminaire 10 of FIG. 2 with the lamp holder assemblies 12 in a back or operating position within the luminaire 10. In this manner, a very tight spacing between the lamps 18 and the reflector 20 may be maintained in a compact, shallow luminaire. In the preferred embodiment, a spacing of less than 2 mm between the lamps 18 and the reflector 20 is provided by the described configuration.

Figure 4:
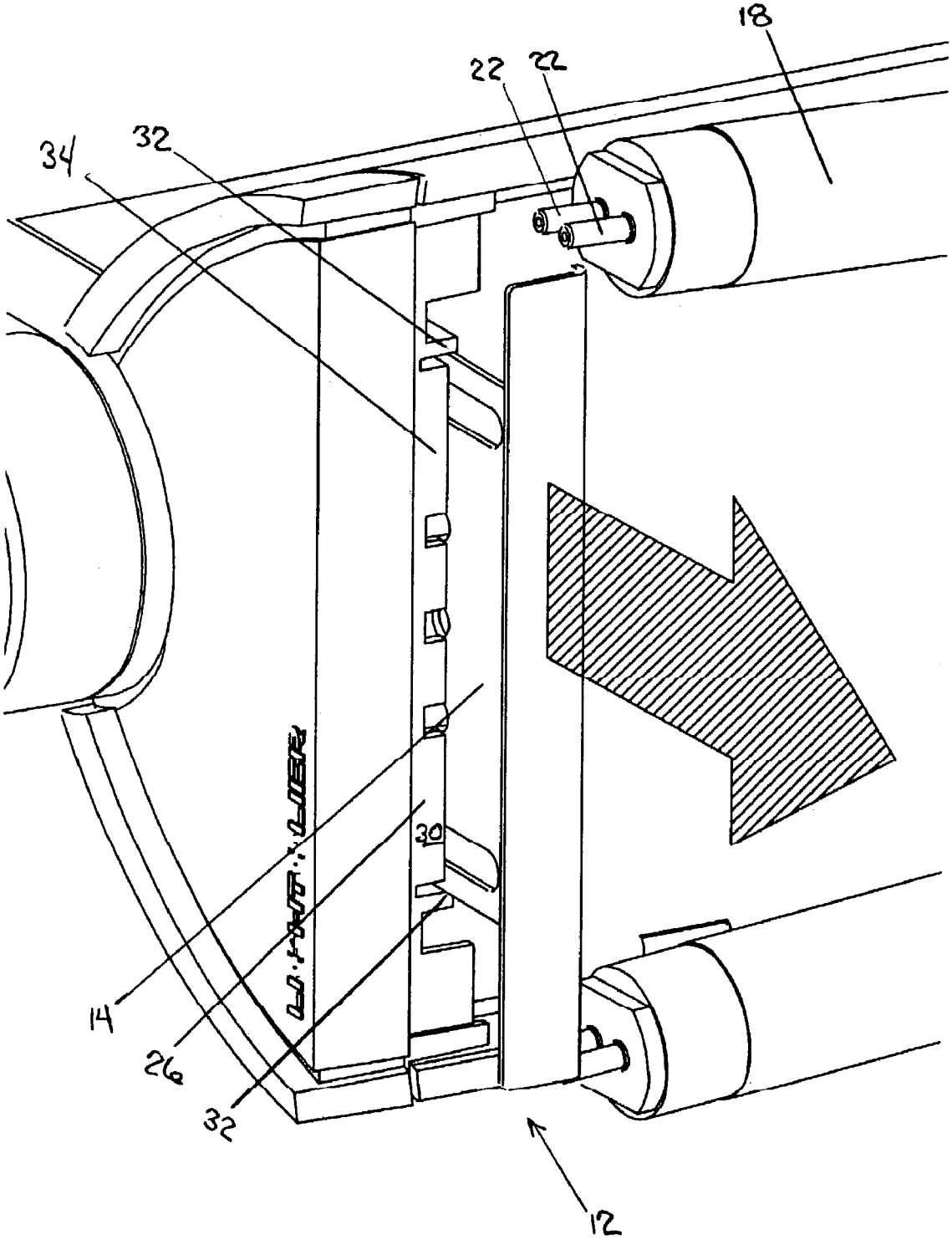
FIG. 4 is a close-up view of a lamp holder assembly of FIG. 2 indicated by line 4—4.

As shown in FIG. 4, the lamp holder assembly 12 has a base member 26 and a bracket member 14. The base member 26 has a front edge 30 and twin parallel rails 32 which run substantially normal to the base front edge 30. Between the rails 32 is a recessed area which forms a channel 34. Thus, the bracket member 14 is held between the rails 32 and rides in the channel 34, which keeps the bracket member 14 in alignment with the rails 32 as it is pulled to its forward position for re-lamping.

Figure 5:
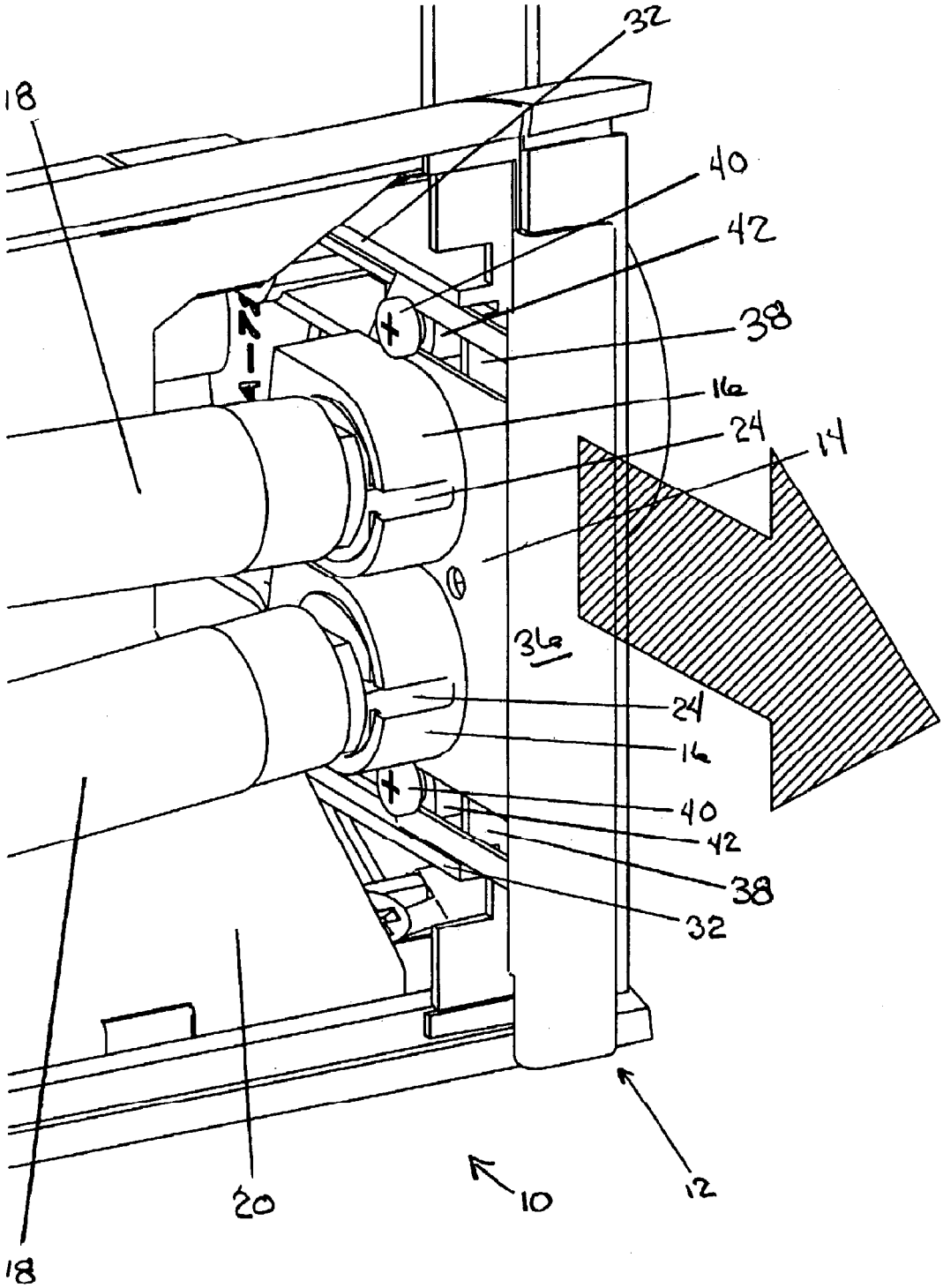
FIG. 5 is a close-up view of a lamp holder assembly of FIG. 2 indicated by line 5—5.

Additionally, as shown in FIG. 5, the bracket member 14 has a front edge 36 and twin parallel slots 38 which run substantially normal to the bracket member front edge 36. The slots 38 cooperate with guide pins 40 to further keep the bracket member 14 in alignment with the base member 26 during movement of the bracket member 14 between its forward and back positions.

The guide pins 40 have heads which have a diameter greater than the width of the slots, in order to retain the bracket member 14 to the base member 26. As shown, the guide pins 40 of the preferred embodiment are screws threaded into screw bosses 42 formed in the base member 26. The screw bosses 42 taper to a neck around which the slots 38 guide the bracket member 14. This configuration allows the screw head to retain the bracket member 14 to the base 26, but prevents over-tightening of the screw which could bind the bracket member 14 to the base 26 and prevent the desired sliding action between the components.

Figure 6:
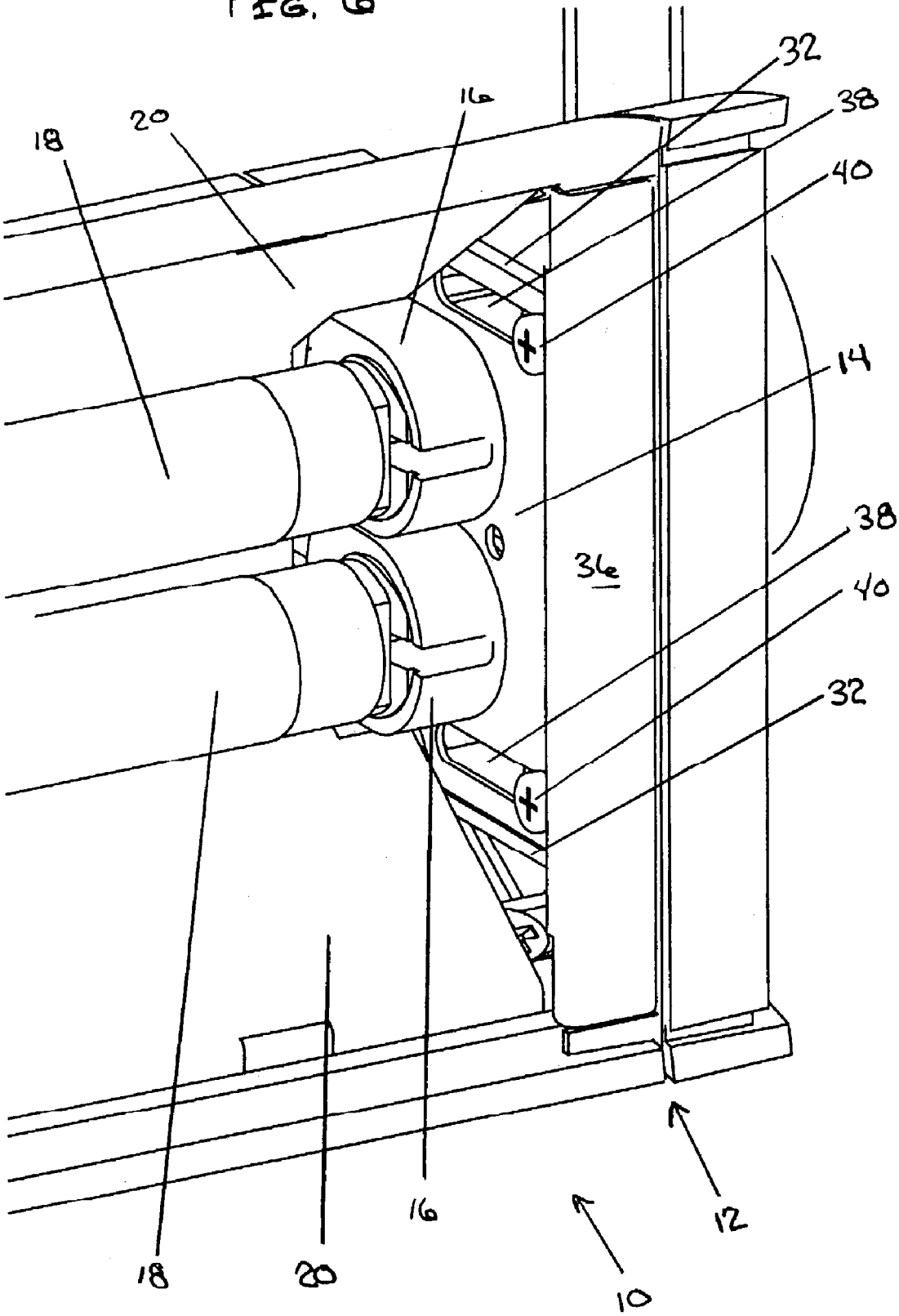
FIG. 6 is a close-up view of a lamp holder assembly of FIG. 3 indicated by line 6—6.

Further, the slots 38 cooperate with the guide pins 40 to limit the travel of the bracket member 14. Thus, as shown in FIG. 5, the slots 38 and guide pins 40 allow the bracket member 14 to be pulled forward for access to re-lamp the luminaire 10, while, as shown in FIG. 6, allowing the bracket member 14 to be pushed back into the luminaire 10 thereby locating the lamps 18 in correct optical position with respect to the reflector 20.

Figure 8:
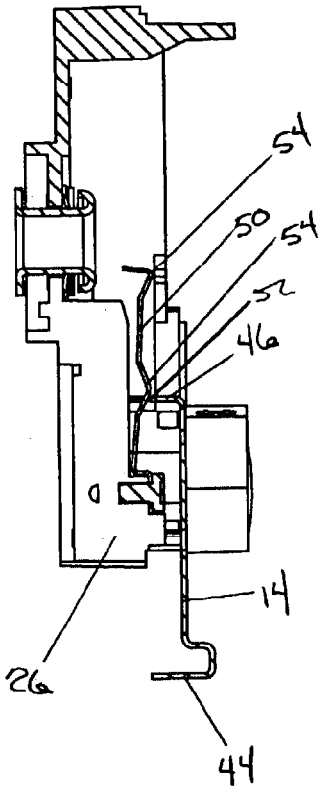
FIG. 8 is a side sectional view taken through the line 8—8 of FIG. 7.
Figure 7:
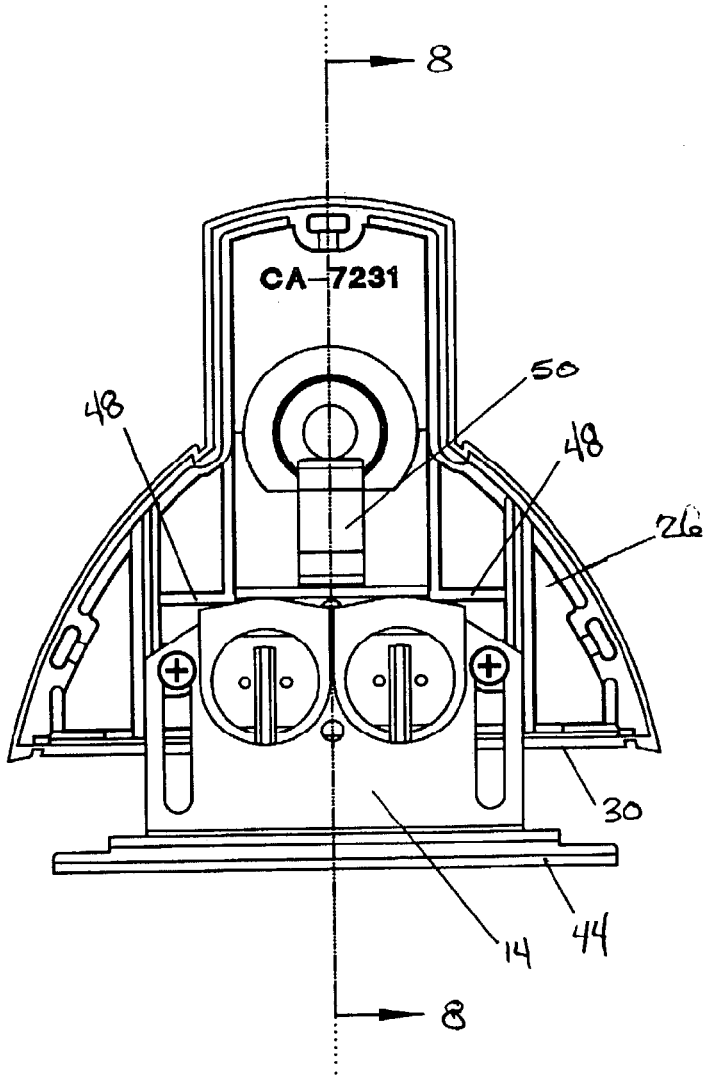
FIG. 7 is a front view of a lamp holder assembly of the present invention.
Figure 9:
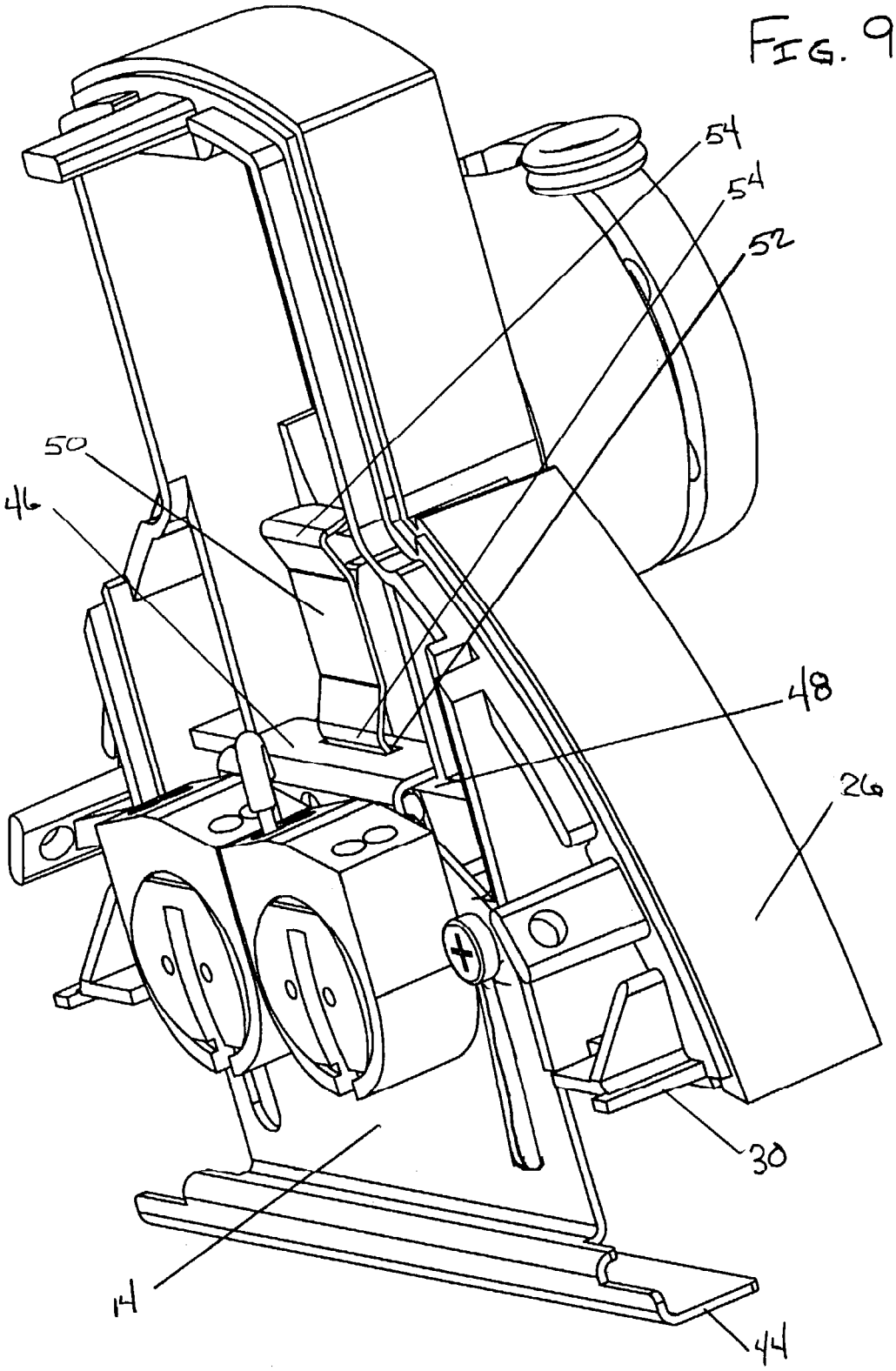
FIG. 9 is a perspective view of a lamp holder assembly of the present invention.

Additionally, as shown in FIGS. 7 through 9, the bracket member 14 may have a front return 44 and a rear return 46 which cooperate with the base member 26 to further limit travel of the bracket member 14. For example, as shown in FIG. 9, with the bracket member 14 in its forward position, the rear return 46 of the bracket member 14 will be stopped from further travel in the forward direction by a rib 48 formed in the base member 26. Likewise, it is apparent that the bracket member front return 44 will be stopped from further travel in the rear direction by the base front edge 30.

Further aiding smooth travel of the bracket member 14, and providing tensioning and a feel of being in position is a leaf spring 50 attached to the base member 26 and running through a leaf slot 52 in the bracket member rear return 46. As shown in FIG. 8, the leaf spring 50 has a bend 54 positioned to provide additional bias against the bracket member rear return 46 at the limits of travel, in order to produce a locating snap feel when the bracket member 14 reaches either limit of travel.

This detailed description of the invention, including specific configurations of elements, shall not be construed as a limitation of the invention, as it will be readily apparent to those skilled in the art that design choices may be made changing the configuration of the lamp holder assembly without departing from the spirit or scope of the invention.

What is claimed is:

1. A pull-out lamp holder assembly, comprising:

a base member having a plurality of guide pins projecting from said base member;

a bracket member with at least one lamp socket attached to said bracket member, said bracket member having a front edge, a back edge with a rear return depending from said back edge, a spring slot through said rear return and a plurality of parallel slots through said bracket member, said plurality of slots running normal to said bracket member front edge and said plurality of slots also being aligned with said plurality of guide pins such that said guide pins engage said slots thereby slidingly connecting said bracket member to said base member; and a leaf spring affixed to said base member, said leaf spring passing through said spring slot so as to provide smooth travel of said bracket member along said base member.

2. The lamp holder assembly of claim 1, said plurality of guide pins each having a top end, each said top end having an outwardly flaring head, each said head having a diameter greater than the width of each of said plurality of parallel slots.

3. The lamp holder assembly of claim 1, each of said guide pins being a screw boss ending with a tapered neck and a screw having a head flaring out from a top end of said screw, said screw threadably affixed and extending outward from said tapered neck, said tapered neck extending through said parallel slot so as to prevent overtightening of said screw.

4. The lamp holder assembly of claim 1, said base member having a rib depending outward therefrom, said rib positioned along said base member such that said rear return contacts said rib when said bracket member is slid to a forward position, preventing further travel in the forward direction.

5. The lamp holder assembly of claim 4, said bracket member having a front return depending from said bracket member front edge such that said front return contacts a front edge of said base member when said bracket member is slid to a rear position, preventing further travel in the rear direction.

6. The lamp holder assembly of claim 5, said leaf spring having at least one bend, said bend providing additional bias against said bracket member rear return to produce a locating snap feel when said bracket member reaches said forward position or said rear position.

7. The lamp holder assembly of claim 5, said base member having twin parallel rails positioned parallel to said plurality of slots and spaced so as to form a channel therebetween, said bracket member being held between said twin parallel rails and riding within said channel.

8. A pull-out lamp holder assembly, comprising:

a base member having a plurality of guide pins projecting from said base member;

a bracket member with at least one lamp socket attached to said bracket member, said bracket member having a front edge, a back edge with a rear return depending from said back edge, a spring slot through said rear return and a plurality of parallel slots through said bracket member, said plurality of slots running normal to said bracket member front edge and said plurality of slots also being aligned with said plurality of guide pins such that said guide pins engage said slots thereby slidingly connecting said bracket member to said base member;

a pair of parallel rails depending from said base member, said parallel rails positioned parallel to said plurality of slots and spaced so as to form a channel therebetween, said bracket member being held between said pair of parallel rails and riding within said channel; and a leaf spring affixed to said base member, said leaf spring passing through said spring slot so as to provide smooth travel of said bracket member along said base member.

9. A pull-out lamp holder assembly, comprising:

a luminaire housing having a reflector disposed adjacent an inner surface of said luminaire housing;

a base member disposed adjacent an end of said luminaire housing and said reflector;

a bracket slidably engaging said base member for retaining said bracket within said base member or exterior to said base member;

a socket disposed on said bracket and slidable with said bracket toward and away from said reflector.

10. A pull-out lamp holder assembly, comprising:

a base member disposed adjacent a luminaire reflector;

a bracket slidably attached to said base member, said bracket slidable between a first position proximate said luminaire reflector and a second position distal from said luminaire reflector;

at least one luminaire socket connected to said bracket which moves proximate to and distal from said luminaire reflector with said bracket;

a biasing member engaging both said base member and said bracket and providing smooth travel of said bracket relative to said base member.

11. A pull-out lamp holder assembly, comprising:

a base member disposed adjacent an end of a luminaire housing;

a bracket slidable relative to said base member from a first position substantially within said luminaire housing to a second position at least partially extending from said luminaire housing;

a biasing member connected to said base member and extending through said bracket providing smooth travel for said bracket relative to said base member;

at least one luminaire socket connected to said bracket and movable relative to said luminaire reflector.

* * * * *